US009486029B2

(12) United States Patent
Galaitsis et al.

(10) Patent No.: US 9,486,029 B2
(45) Date of Patent: Nov. 8, 2016

(54) SOLID-LIQUID ENERGY DISSIPATION SYSTEM, AND HELMET USING THE SAME

(71) Applicant: Raytheon Company, Waltham, MA (US)

(72) Inventors: Anthony G. Galaitsis, Lexington, MA (US); Michael V. Hynes, Cambridge, MA (US); John J. Finkenaur, South Hamilton, MA (US)

(73) Assignee: Raytheon Company, Waltham, MA (US)

( * ) Notice: Subject to any disclaimer, the term of this patent is extended or adjusted under 35 U.S.C. 154(b) by 100 days.

(21) Appl. No.: 14/450,591

(22) Filed: Aug. 4, 2014

(65) Prior Publication Data

US 2015/0272255 A1 Oct. 1, 2015

Related U.S. Application Data

(60) Provisional application No. 61/972,696, filed on Mar. 31, 2014.

(51) Int. Cl.
*A42B 3/12* (2006.01)

(52) U.S. Cl.
CPC ..... *A42B 3/121* (2013.01); *A42B 3/122* (2013.01)

(58) Field of Classification Search
CPC ..... A42B 3/00; A42B 3/06; A42B 3/122; A42B 3/044; A63B 71/10; C08J 5/18; B82Y 30/00
USPC ..... 2/411–413, 425, 906; 428/327, 402.21, 428/402, 403, 406
See application file for complete search history.

(56) References Cited

U.S. PATENT DOCUMENTS 4,158,087 A 6/1979 Wood
4,343,047 A * 8/1982 Lazowski ..... A42B 3/125 2/411
4,722,946 A 2/1988 Hostettler
(Continued)

FOREIGN PATENT DOCUMENTS

EP 2319880 A2 9/2006
EP 2103374 B1 8/2008
(Continued)

OTHER PUBLICATIONS

"Virginia Tech Helmet Ratings, Adult Football Helmet Ratings—May 2013", Virginia Tech Wake Forest University School of Biomedical Engineering and Sciences, [retrieved online Feb. 17, 2014], <http://www.sbes.vt.edu/nid>.

*Primary Examiner* — Tejash Patel
(74) *Attorney, Agent, or Firm* — Renner, Otto, Boisselle & Sklar, LLP

(57) ABSTRACT

A helmet includes one or more pads on an inside surface of a shell, with the pads including a cushioning material that includes porous particles within a carrier liquid. The surfaces of the pores of the particles are lyophobic, resisting wetting by the carrier liquid. When the carrier liquid is placed under sufficient pressure, for example by an impact against the pad, the carrier liquid is forced into the pores. This causes the system to store and absorb energy within the carrier liquid. The pad may be made of flexible material with a pair of opposed major surface face pieces, with cells full of the liquid and particles extending between the face pieces. The liquid and particles may make up a majority of the volume of the pad, for example being at least 50% of the volume of the pad.

32 Claims, 6 Drawing Sheets

(56) References Cited

U.S. PATENT DOCUMENTS

| | | | | |
|---|---|---|---|---|
| 5,263,203 | A | 11/1993 | Kraemer et al. | |
| 5,599,290 | A | 2/1997 | Hayes et al. | |
| 5,675,844 | A * | 10/1997 | Guyton | A41D 13/015 2/22 |
| 5,815,846 | A * | 10/1998 | Calonge | A42B 3/121 2/413 |
| 6,032,300 | A * | 3/2000 | Bainbridge | A41D 13/015 2/16 |
| 6,052,992 | A | 4/2000 | Eroshenko | |
| 6,154,889 | A | 12/2000 | Moore, III et al. | |
| 6,226,820 | B1 * | 5/2001 | Navarro | A47C 27/085 5/654 |
| 6,883,181 | B2 | 4/2005 | Long | |
| 7,299,505 | B2 | 11/2007 | Dennis et al. | |
| 7,574,760 | B2 | 8/2009 | Foley et al. | |
| 7,767,301 | B2 | 8/2010 | Galaitsis | |
| 7,774,866 | B2 | 8/2010 | Ferrara | |
| 7,794,827 | B2 | 9/2010 | Palmer et al. | |
| 7,895,681 | B2 | 3/2011 | Ferrara | |
| 7,904,971 | B2 * | 3/2011 | Doria | A42B 3/127 2/410 |
| 8,171,585 | B2 * | 5/2012 | Mead | A41D 31/0044 2/455 |
| 8,528,118 | B2 | 9/2013 | Ide et al. | |
| 8,528,119 | B2 | 9/2013 | Ferrara | |
| D695,966 | S | 12/2013 | Futterer | |
| 8,814,150 | B2 | 8/2014 | Ferrara et al. | |
| 2006/0234577 | A1 | 10/2006 | Wagner et al. | |
| 2006/0277664 | A1 | 12/2006 | Akhtar et al. | |
| 2011/0283433 | A1 | 11/2011 | Holt et al. | |
| 2013/0125294 | A1 | 5/2013 | Ferrara | |
| 2013/0133138 | A1 | 5/2013 | Sugano et al. | |
| 2013/0269089 | A1 | 10/2013 | Green et al. | |

FOREIGN PATENT DOCUMENTS

| | | | |
|---|---|---|---|
| EP | 2361023 | B1 | 12/2009 |
| WO | 2008088974 | A2 | 7/2008 |

* cited by examiner

SOLID-LIQUID ENERGY DISSIPATION SYSTEM, AND HELMET USING THE SAME

This application claims priority to U.S. Provisional Application 61/972,696, filed Mar. 31, 2014, which is incorporated herein in its entirety.

FIELD OF THE INVENTION

The invention relates to shock management systems, and to such systems used in devices such as helmets.

DESCRIPTION OF THE RELATED ART

High energy impacts may be experienced in vehicle collisions, airplane and train crashes, underwater shocks applied to ships and sea-based oil platforms, highway barrier collisions, abrupt, high level forces applied to airplane landing gear components or between components of any vehicles or machinery, and other physical interactions and may result in extensive damage to the applicable equipment (e.g., the vehicle, vessel, airplane, roadside barrier, etc.), and injury to passengers and personnel. During such interactions shock energy may either be reflected towards the source of the energy, accumulated by the receiver, transmitted through the receiver to surroundings, or some combination of these. Accumulated energy may be dissipated, stored and retrieved, and/or converted to another form of energy and used for a desired purpose.

Traditional techniques for protecting objects from being damaged by incident energy pulses are sometimes applied to or integrated into materials used for protecting the equipment. Such materials include elastically deformable components, e.g., coil springs, foam, sand, gels, rubber or other elastomeric materials, or shock absorbing pads with polyurethane or other similar materials, etc., and supporting welds or other metal anchors.

Unfortunately, current materials tend to have limited utility in storing, dissipating and releasing the energy from forces applied at high frequencies, high magnitude loads (forces or pressures), or a combination of these in a controlled manner. For example, the energy from vehicle collisions is partially dissipated by the vehicle bumpers, and partially transmitted to other vehicle components or the surroundings, resulting in vehicle damage or passenger injury as well as damage to surrounding objects and other people. For high speed collisions, current bumpers are largely unable to prevent extensive damage to the vehicle and serious injuries of the passengers.

Similarly, underwater blasts may compromise the integrity of, or permanently disable, ships, submarines, and other underwater vehicles or structures. The effects of collisions and damage arising from inadequate protective equipment are manifested in other areas beyond transportation. For example, air-dropped articles or equipment subject to abrupt and high loads are often mechanically compromised or irreparably damaged upon arrival at appointed locations.

Although improvements have been developed in recent years, for example as shown in U.S. Pat. Nos. 6,052,992 and 7,767,301 (the specifications of which are incorporated by reference herein), further progress is needed still for mitigating the effects of high-load and/or high frequency impacts caused by collisions or incident shock waves.

Much effort and ingenuity has been directed over the last decades into protecting the heads of human beings, and the contents of said heads, in the growing recognition of possibly long-term neurological deficits that can be caused by concussions or other brain traumas (traumatic brain injuries). The problem extends to a wide variety of activities, including recreational activities such as team sports (football, hockey, lacrosse, and baseball, to give a few examples) and riding activities (such as motorcycle riding, bicycle riding, and horseback riding), military operations (paratrooper jumps, effects of explosions from improvised explosive devices being one particular area of concern, and blunt force impacts and ballistic impacts are more general areas of concern), and occupations such as construction work. Despite the variety of helmet configurations tried, the use of different shell materials and configurations, and the use of pads with different types of foam materials or the use of inflatable padding, there is a recognition that human brains are still at severe risks in these activities. The problem has reached the point where some have predicted the long-term demise of risky team sports, such as football or hockey.

SUMMARY OF THE INVENTION

According to an aspect of the invention, a helmet includes shock-absorbing pads that contain porous particles in a carrier fluid. The porous particles have pores with lyophobic surfaces that resist entry of the carrier fluid into the pores until the carrier fluid reaches a certain value or values of pressure.

According to another aspect of the invention, a helmet includes: a shell; and a pad within the shell, for example being affixed to an inner surface of the shell. The pad includes a shock-absorbing material. The shock-absorbing material includes: a carrier liquid; and solid porous particles with pore surfaces that are lyophobic with respect to the liquid.

According to yet another aspect of the invention, the shock-absorbing material includes: a carrier liquid; and solid porous particles within the liquid. All surfaces of the particles (pore walls and outer surface of particles) are lyophobic with respect to the liquid.

According to yet another aspect of the invention, a shock-absorbing material includes: a carrier liquid; and solid porous particles within the carrier liquid. Each of the particles has homogeneous material content throughout. Material of the particles is lyophobic with respect to the carrier liquid.

According to still another aspect of the invention, a shock-absorbing pad includes: a flexible multicell structure having a plurality of sealed cells; and a shock-absorbing material in the cells. The shock-absorbing material includes: a liquid; and solid porous particles within the liquid that have lyophobic pores. The cells constitute at least 60% of the volume of the pad.

According to a further aspect of the invention, a method of configuring a shock-absorbing material, the method including the steps of: providing desired stress versus strain characteristics of the material; and selecting multiple types of lyophobic porous particles for placement within a liquid of the shock-absorbing material, in order to have the shock-absorbing material approximate the desired stress versus strain characteristics.

In one or more embodiments, a plurality of porous particles is distributed in a carrier liquid, forming part of a shock absorbing pad or other device. The particles have surfaces of pores that are lyophobic (e.g., non-wetting or liquid-repellant) with respect to the carrier liquid. The pores may make up 50% or more, or 80% or more, of the volume of the particles. The particles may be homogeneous in composition, made of a lyophobic material. Alternatively, the particles may be made of a lyophilic (wetting) material, and/or may have exposed surfaces coated in whole or in part. The Laplace pressure, the pressure within the carrier liquid that is sufficient to drive the carrier liquid into the pores, may be 100 psi or less, or may be less than 50 psi, for example being from 10-50 psi or from 20-40 psi.

The carrier liquid, with the particles therein, may be included in a pad, sealed within one or more voids within the pad. There may be multiple voids between faces of the pad that constitute major surfaces, with the voids being separate cells separated by walls that prevent fluid communication between the cells. The faces and the walls may be made of a flexible material, such as rubber, and the carrier liquid and particles may constitute at least 50%, or at least 80%, of the volume of the pad. The pad may be place on the inside surface of a shell, such as a hard shell, of a helmet for military use or civilian use (such as for use in athletics and/or other recreational and/or occupational activities).

The carrier liquid may contain multiple types of particles, for example having particles with different pore sizes. The particles may be selected in order to achieve desired stress/strain characteristics for the resulting pad or other device, for example to replicate stress/strain behavior of other types of padding.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A helmet includes one or more pads on an inside surface of a shell, with the pads including a cushioning material that includes porous particles within a carrier liquid. The surfaces of the pores of the particles are lyophobic. The lyophobic particles prevent the carrier liquid from entering the pores below the Laplace pressure, a property of the liquid/particles defined below. When the carrier liquid is placed under sufficient pressure, for example by an impact against the pad, the carrier liquid is forced into the pores. This causes the system to store and absorb energy within the carrier liquid. The pad may be made of flexible material with a pair of opposed major surface face pieces, with cells full of the liquid and particles extending between the face pieces. The liquid and particles may make up a majority of the volume of the pad, for example being at least 50%, at least 65%, at least 70%, or at least 80% of the volume of the pad. The Laplace pressure, the pressure at which the liquid is forced into the pores, may be around 30 psi. There may be multiple types of particles in the liquid, for example, each with a different Laplace pressure, to replicate a desired stress vs. strain curve.

Figure 1:
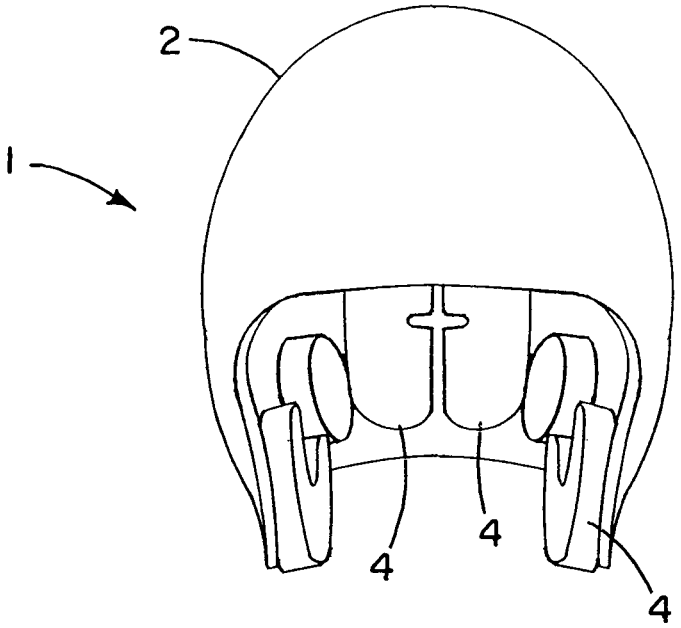
FIG. 1 is a front view of a helmet configuration that may be used as part of an embodiment of the present invention.
Figure 2:
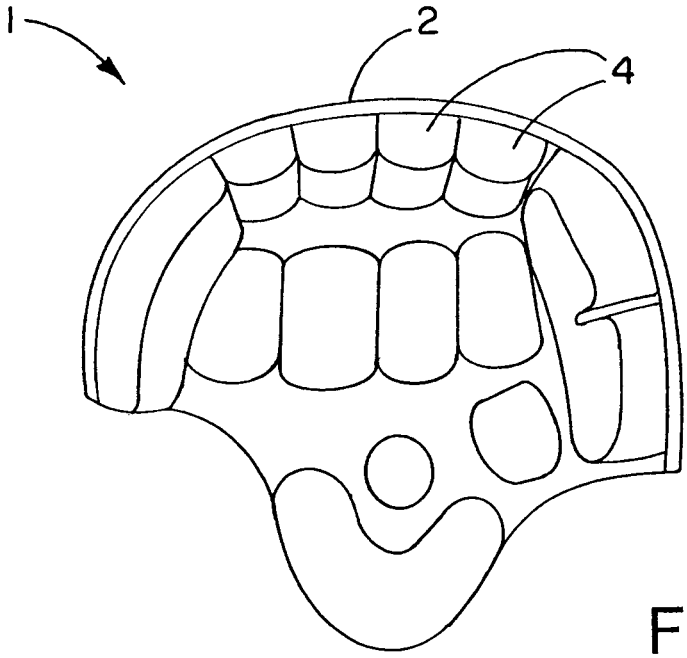
FIG. 2 is a side sectional view of the helmet of FIG. 1.

Referring initially to FIGS. 1 and 2, a helmet 1 is shown that is used to protect the head of a user. The helmet 1 has an outer shell 2, and a series of shock-absorbing pads 4 on an inner surface of the shell 2. The pads 4 are used to at least partially ameliorate shocks received by the helmet, reducing the magnitude of forces transmitted to the head of the user. The outer shell 2 may be made of a hard material, such as hard plastic, metal, and/or a resin material. Such a hard material may help the outer shell 2 retain its shape and integrity, even when receiving hard shocks or blows. The shell 2 may also include other material, such a foam layer or other cushioning layer on its external surface. The helmet 1 may optionally include other structures, such as any of a variety of suitable faceguards and/or retention devices, such as chin straps.

The pads 4 may include shock-absorbing material. Specifically, one or more of the pads 4 may include or may be primarily made up of, a liquid with lyophobic porous particles located within the liquid. Example embodiments of the liquid-particle mixture, and of pads including such a mixture, are described below. In addition, the liquid-particle mixture and the pads described below may be used in any of a wide variety of devices other than helmets.

The helmet 1 may be the basis for helmets for a variety of civilian and military uses. Civilian uses may include athletic uses, such as for use in team sports such as football, hockey, or lacrosse, in other recreational activities, such as for hang gliding or mountain climbing, for operating any of a variety of powered or unpowered vehicles, such as bicycles or motorcycles, or for occupational activities, such as hard hats for construction work or other work. The helmet 1 may have any of a variety of configurations appropriate for use, and may include any of a variety of additional features, such as face masks, eye protection, built-in communication devices, ventilation holes, etc.

Figure 3:
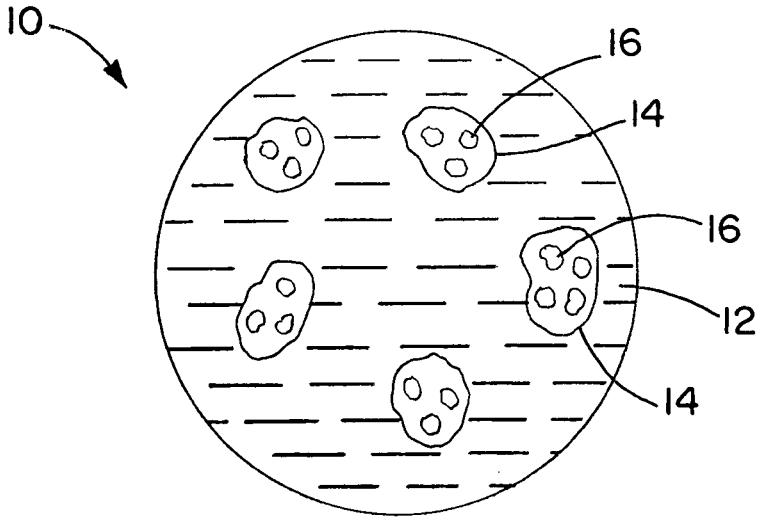
FIG. 3 is a conceptual view of a shock-absorbing liquid-solid material in accordance with an embodiment of the present invention.
Figure 4:
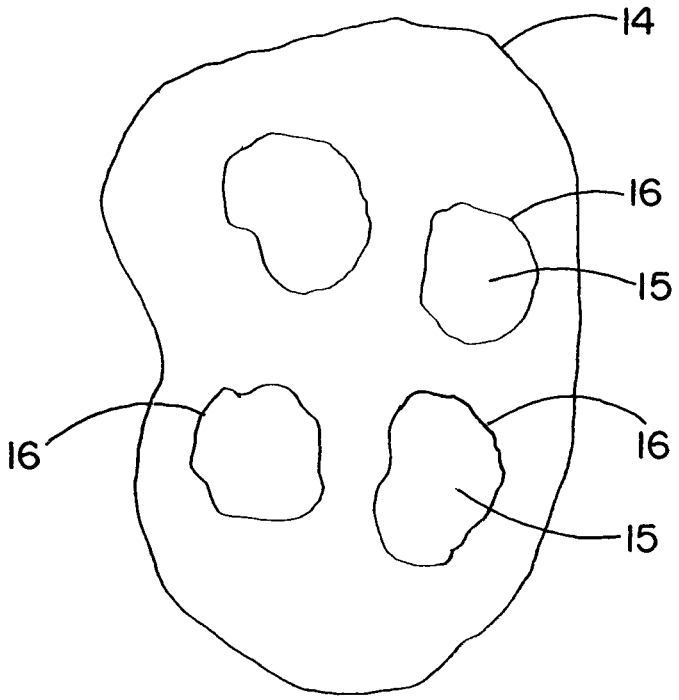
FIG. 4 is a representation of a porous particle that is part of the shock-absorbing material of FIG. 3.

Referring now to FIGS. 3 and 4, a shock-absorbing material 10 includes a carrier liquid 12, and porous particles 14 located within the carrier liquid 12. The heterogeneous-structure shock-absorbing material 10 may be considered a colloidal material, with the particles 14 being a dispersed phase within the continuous phase of the carrier liquid 12. As explained in greater detail below, the surfaces 15 of at least open pores 16 of the particles 14 are lyophobic with respect to the carrier liquid 12. The term "pores" is used herein to broadly indicate surfaces of the particle 14 that are within the overall envelope of the individual particle 14, and are in fluid communication with areas outside of the particle 14, where the liquid 12 is located. The pores 16 may have any of a variety of shapes, sizes, and/or configurations, some of which will be discussed herein. That the pore surfaces 15 are lyophobic means that the carrier liquid 12 is repelled by the pore surfaces 15. Only when the liquid 12 is under sufficient pressure, such as when absorbing a shock, does the liquid 12 enter into the pores 16. The pressure threshold that needs to be crossed to force the liquid 12 into the pores 16 corresponds to the Laplace-Young capillary pressure ("the Laplace pressure"), which has a given by the equation $P=(2\sigma|\cos\theta|)/r$, where $\sigma$ is the surface tension of the liquid of the heterogeneous structure at the temperature under consideration, $\theta$ is the contact angle (said angle being necessarily greater than 90° because of the above-specified lyophobic characteristic), and r is the radius (or other relevant dimension) of the pore or capillary channel 16.

Figure 5:
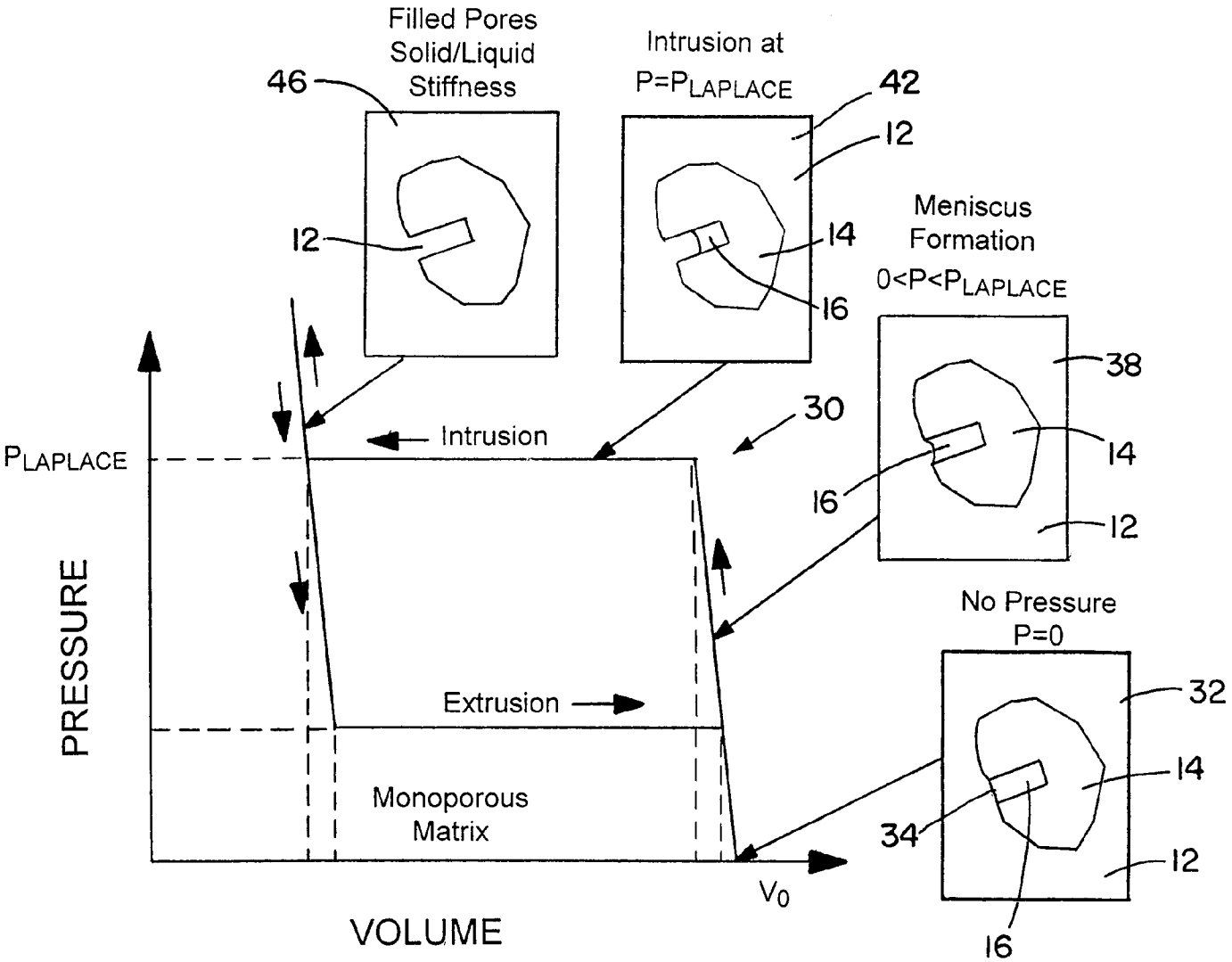
FIG. 5 is a graphic and conceptual diagram illustrating operation of the material of FIG. 3.

The shock-absorbing material (heterogeneous structure) 10 operates by absorbing energy by forcing the carrier liquid 12 into the pores 16, flooding the pores 16, when receiving a sufficient pressure, such as when subjected to a shock. Referring now in addition to FIG. 5, a typical response to a pressure event is shown. The forced compression (as by a shock or other pressure-producing event is represented diagrammatically at reference number 30 in FIG. 5, in which there can be seen a situation in which initially, at reference number 32, the liquid 12 is present at the entrance to the pore 16 formed in the particle 14, but without being able to penetrate into the pore 16, so that the liquid frontier is constituted by a meniscus 34.

Increasing the pressure, but at values still below the Laplace pressure $P_L$, produces the situation at 38, wherein the meniscus 34 is more pronounced, but there is still no liquid column in the pore 16. Once the Laplace pressure $P_L$ is reached, the liquid begins to get forced into the pore 16, as shown at reference number 42. Note that the volume of the system reduces, while the pressure remains relatively flat. The forcing of the liquid 12 into the pores 16 results in work done by the applied pressure. Finally, at reference number 46 the pore 16 becomes fully filled with the liquid 12.

Because of the compression applied to the heterogeneous structure, the liquid 12 has been forced to penetrate into the pores 16. The effect of going from the situation at 32 to the situation at 46 is to increase the area of the liquid/solid interface, which can be written $\Omega$, with the change $\Delta\Omega$ corresponding to the area of the walls of the pores concerned. Thus, the solid/liquid separation surface (or interface) area varies as a function of the external pressure to which the heterogeneous structure is subjected, thereby enabling work to be done. When the pressure applied to the heterogeneous structure is released, spontaneous expansion is thus obtained which reverses the filling of the pores 16.

The shock-absorbing material 10 is described herein as colloidal. This term should be broadly interpreted as referring to the particles 14 being distributed within the liquid 12, without regard to the uniformity (or lack of uniformity) in the dispersal of the particles 14 within the liquid 12.

Many variations are possible concerning the materials and configuration of the particles 14, some of which are described herein and/or in the previously-referenced U.S. Pat. Nos. 6,052,992 and 7,767,301. As noted above, the pores 16 have to have lyophobic exposed surfaces. External surfaces of the particles 14, other than those of the pores 16, may be either lyophobic or lyophilic. The material of the particles may itself be a lyophobic material, with the particles 14 having a homogeneous material content throughout, thereby providing a lyophobic surface to the pores 16. Alternatively all or part of the exposed surfaces of the particles 14 may be coated, for example with a coating that provides a desired lyophobic surface at the pores 16 and/or to the external surfaces of the particles 14 outside of the pores 16.

Certain advantages to having lyophilic outside surfaces for the particles were discussed in U.S. Pat. No. 7,767,301. Lyophilic outside surfaces allow the liquid to have better (more immediate) access to the pores 16. Also, particles with lyophobic external surfaces (such as those described in U.S. Pat. No. 6,052,992) can cause particles to agglomerate. The particles may be sufficiently small that their flocculation results in the generation of a porous mass that itself must be infiltrated by the fluid before the fluid can penetrate into the pores, thus negating the advantages gained by decreasing particle size. Because particles produced according to an embodiment of the present invention have a lyophilic exterior surface, the liquid in such a configuration wets the exterior of the particles in the absence of an applied pressure and is able to begin penetrating the pores of all the particles as soon as the applied pressure exceeds the Laplace pressure.

The agglomeration of the particles also creates difficulty in manufacturing. The flocculate tends to float in the fluid (because the pores and inter-particle voids are either completely empty (e.g., under vacuum) or filled with air, either at ambient pressure or under partial vacuum), making it difficult to encapsulate the particles and fluid using standard manufacturing techniques.

Notwithstanding the above considerations, in other embodiments particles with lyophobic exterior surfaces may be employed.

In one embodiment, the particles are produced by providing a porous bulk starting material. All the surfaces of the material, interior and exterior, are rendered lyophobic with respect to the expected carrier fluid. For example, if the carrier fluid is water, then the surfaces are rendered hydrophobic. For a glass or other hydrophilic starting material, the surfaces are thus coated with a hydrophobic material. The bulk starting material is then broken into smaller particles. The newly exposed exterior surfaces of the smaller particles have the composition of the uncoated starting material. For example, for a glass starting material, the exterior surfaces of the ground particles will be the hydrophilic glass surface, while the interior surfaces surrounding the pores will have the hydrophobic coating. The ground material has substantially the same volume as the starting material, but a significantly greater surface area, magnifying the access of the carrier fluid to the pores.

A small fraction of the particles will include a portion of the exterior surface, with its lyophobic coating. However, for each of these particles, only a small portion of their surfaces will include the coating. The small fraction of the total exterior surface area of the particles that remains lyophobic has a negligible effect on performance. It is not necessarily desirable that the coating be such that it will be abraded from the exterior surface of the particles as they are ground.

The above method of forming particles with lyophobic pores and lyophilic external surfaces is only an example of one way of forming the particles 14 (FIG. 3). Many other ways are possible for forming the particles 14.

The particle shape is not critical to the functioning of the system. The particles may have rounded edges if they are ground, but this is not necessary, and different production methods may result in different particle shapes, for example, spherical, ovoid, cylindrical, or polyhedral. Non-centrosymmetric particles are also appropriate for use according to an embodiment of the invention. In one embodiment, the particles are small, to maximize the available external surface area for a given volume of particles. However, the particles should be sufficiently large to accommodate fluid flow into and out of pores. The pores may form one or more interconnected networks.

Many possible configurations may be used for the pores 16 (FIG. 3). The pores 16 may be holes, slots, tubular capillary passages, channels of constant or varying cross sectional shape, and intersecting channels, to give a few example configurations. The term "pores" should be interpreted broadly as including openings and passages of whatever shape but of nominally uniform cross sectional area for receiving liquid 12 (FIG. 3) within the envelope of the particle 14 (FIG. 3).

Generally, a reduced particle size facilitates the liquid/pore interaction due to the increased amount of external particle surface per unit mass available for contact with the fluid. This is particularly beneficial for short duration pulses where there is very little time available for the liquid penetration into the lyophobic pores. The optimal particle size will depend in part on the frequency and/or the magnitude of the impact (e.g., is the energy applied slowly or quickly), and may range from 2500 mesh or smaller (e.g., 5 micron or less) to 0.5 mm or greater, for example, between 2500 mesh and 400 mesh, between 400 mesh and 140 mesh, between 140 mesh and 60 mesh, between 60 mesh and 30 mesh, or between 30 mesh and 16 mesh. These sizes are only examples, and a wide variation of other suitable sizes are possible.

The pore size and other liquid/particle properties may be manipulated to optimize the Laplace pressure for the system. The contact angle is greater than 90 degrees for lyophobic liquid/solid pairs. In one embodiment, the pores are approximately uniform in cross-sectional area. In this embodiment, the Laplace pressure is about the same for all of the pores, and fluid is able to penetrate substantially all of the pores when the applied pressure reaches the Laplace pressure, thus displaying the intrusion plateau in the pressure-volume responses curve (see FIG. 5). There also may be variations in pore size within the same particle, or in different particles. Variations in the pore size will contribute to slope in the pressure-volume curve, or to different regions of plateaus and nonzero slope. In some embodiments, the pore size distribution is sufficiently narrow that, at the Laplace pressure, the pressure-volume curve is essentially flat (e.g., volume decreases without a corresponding increase in pressure). For example, FIG. 5 corresponds to ideal monoporous (having pores with the same diameter) particles, characterized by a single Laplace (or intrusion) pressure. In another embodiment, the pores are randomly sized. Alternatively, the pores may be deliberately sized but may have more than one size, for example, with the system having two or three different sizes of pores. Where the pore size distribution is multimodal, the system will exhibit several Laplace pressures, one for each pore size. The desired pore size distribution will vary depending on the expected applied pressure and the size and shape of the object being protected. Depending on the application, the pore size may range from 2-1000 nanometers, but may also be higher; for example the pore size may be 2-10 nm, 10-50 nm, 50-100 nm, 100-200 nm, or 200-1000 nm or higher.

For use as in a shock-absorbing pad in a helmet, the particles 14 (FIG. 3) may have a size (e.g., a diameter) of up to 500 μm (0.5 mm), or from 1 μm to 500 μm (0.5 mm). As mentioned in the previous paragraphs, a wide range of other sizes are possible.

For a given pore size, the energy storage capacity of a porous particle is proportional to porosity (total pore wall surface per unit volume). Therefore, the energy storage capacity may be increased by increasing particle porosity. However, as the porosity increases, the average wall thickness between adjacent pores decreases and the structural strength of the porous particle is reduced. Depending on the application, the maximum porosity may be optimized to prevent the particles from being pulverized when subjected to the maximum expected pressure. Thus, the particles may be between 20 and 80% porous, for example, between 20 and 30%, between 30 and 40%, between 40 and 50%, between 50 and 60%, between 60 and 70%, or between 70 and 80%. The particles 14 (FIG. 3) may be at least 50% porous (at least 50% voids), at least 80% voids, or from 50-60% porous. Depending on the application, the ratio of the particle diameter to the pore diameter may be at least 5:1, at least 10:1, at least 50:1, at least 100:1, at least 250:1, or at least 500:1, at least 1000:1, at least 2500:1, at least 5000:1 or even larger.

The ratios of incident energy transmitted through, dissipated in, and reflected from a given particle/fluid mixture depend on the properties of the mixture. The particle/carrier liquid mixture may be configured to store, reflect, and/or dissipate a certain amount of energy from an applied impact force, while transmitting a smaller portion of the energy to a protected object.

In some embodiments, the particle/carrier fluid mixture is configured to dissipate, transmit or reflect incident energy resulting from pressures of different magnitude, for example, energy resulting from applied pressures of at least 10 psi, at least 50 psi, at least 100 psi, at least 1000 psi, at least 2500 psi, or at least 10,000 psi. In some embodiments, the energy transmitted to the protected object is less than 70%, less than 50%, less than 20%, or less than 5% of the incident energy. In some embodiments, the particle/fluid mixture may be configured to accumulate energy rapidly (e.g., with high power—energy per unit time) but to release it at a lower rate (e.g., with lower power). The ratio of the power of the incident energy to that of the released energy may be at least 5, at least 10, or at least 100. The particle/carrier fluid mixture may be configured to optimize performance for a force applied with a frequency of at least 1000 Hz, at least 10,000 Hz, at least 100,000 Hz, or at least 1 MHz. Alternatively the particle/carrier fluid mixture may be optimized for different expected durations and/or magnitudes of force applied, such as from the expected force to be applied to a helmet.

For certain embodiments described herein, the particles 14 (FIG. 3) may be configured in order to have pores 16 (FIG. 3) with a Laplace pressure less than 100 psi or less than 50 psi, for example a Laplace pressure of about 30 psi, or between 20 psi and 40 psi, and from 10 psi and 100 psi. The Laplace pressure or pressures may be affected by not only the dimensions and void fraction for the pores 16, but also the interaction between the carrier liquid and the material of the particles 14 (or the coating on parts of the particles 14). The Laplace pressure of less than 100 psi, or less than 50 psi, may be useful in absorbing shocks in a helmet, such the helmet 1 (FIG. 1) described above.

The particles 14 may be made as an aerogel or other open-celled foam. Aerogels are porous materials derived from gels, in which the liquid component of the gel has been replaced with a gas. By controlling the composition of the gel the properties of the resulting aerogel particle may be controlled, for example to specify desired void fractions and strength (rigidity) of the resulting particles.

The particles may be fabricated from practically any material—metals, ceramics, polymers, or semiconductor materials. The material should be sufficiently stiff that it will not deform significantly under pressure, (e.g., to prevent the pores from collapsing), and sufficiently friable to be ground. For example, the material should not deform significantly under imposed pressures during use but also simply under the weight of the material layered above it when "at rest" or being stored for production of protective items. Exemplary materials for use as particles include chromium-silica compounds, aluminosilicates, silica gel, glass, graphite, porous sodium borosilicate glass, alumina, and thermoset polymers such as acrylates (e.g., Lexan™), poly(vinyl chloride) and Bakelite. Representative examples include controlled porosity glass, available from Prime Synthesis (Aston, Pa.) and Millipore (Burlington, Mass.), and silica gel available from Waters Corp. (Milford, Mass.). Porous metals may be obtained from companies such as Mott Corporation, Purolator, Solea SAS, and Inco.

The pores may be rendered lyophobic by coating them with any of a variety of materials. The coating may adhere to the pore walls sufficiently strongly that the motion of the fluid flowing into and out of the pores under pressure does not shear the coating from the pores. The thickness of the coating may be sufficiently great to provide coherence without clogging the pores. In some embodiments, the coating is about 1 nm thick. In one embodiment, the pores may be coated with poly (tetrafluoroethylene) in much the same way that cookware is.

The particles, such as with the lyophilic surfaces and lyophobic pores (or with other configurations), do not accumulate energy on their own. Rather, they do so when combined with a carrier liquid that penetrates the pores when the Laplace pressure is exceeded. An ideal fluid from a viscosity and surface tension standpoint is mercury; however, mercury is not suitable for some applications due to its density and toxicity. For glass and other hydrophilic materials (e.g., with interior surfaces rendered hydrophobic through suitable coatings), water or alcohols may be used as the carrier fluid. Other fluids that may be suitable for use with the invention include but are not limited to aqueous, polar, and electrolytic solutions. The choice of fluid depends partially on the temperature at which the system will be used. Some alcohols, such as ethanol and isopropanol, have lower melting points than water and may be used at colder temperatures. Of course, they will also boil at lower temperatures and may not be suitable for use in high temperature environments. One skilled in the art will recognize that liquids may be combined to change their boiling points, freezing points, or viscosities. Alternatively or in addition, it may be desirable to use additives to optimize other properties. For example, a biocide may be added to water to prevent the growth of bacteria that may coat the pore walls or the outer surfaces of the particles, or a solute (e.g., salt) may be added to water to reduce its freezing point. For example, it may be desirable to reduce the freezing point of the liquid to −30 degrees C. or lower. Mixtures of solvents may also be used to modify the viscosity or surface tension of the fluid or to adjust boiling or freezing points. The viscosities, melting points, and boiling points of a plethora of fluids are listed in the Handbook for Chemistry and Physics (D Lide, Editor in Chief, 1991, CRC Press, Boca Raton), the entire contents of which are incorporated by reference herein. The melting points and boiling points for a wide variety of mixtures of solvents may be found by reference to any encyclopedia of binary phase diagrams, e.g., Phase equilibria and phase diagrams of electrolytes (H. Engels, 1990, Dechema, Frankfurt/Main), the entire contents of which are incorporated herein by reference.

The particles 14 may be selected, in conjunction with the carrier liquid 12, to achieve a desired stress-strain relationship (curve) for the shock-absorbing heterogeneous-structure material 10. The desired stress-strain curve for the material 10 may be provided to have the material 10 behave in a manner similar to that for a solid foam material (or another material), or to reach some other desired stress-strain curve. The configuring of the material 10 may include selecting multiple types of particles, for example with different pore sizes, to have various pores of the particles triggered (flooded) at various Laplace pressures to achieve whatever stress-strain relationship is desired. The configuring may include selecting other factors of the energy-absorbing material 10, such as picking size and/or shape of the particles 14, size of the pores, configuration of the pores, material of the particles 14, and the material properties of the liquid 12.

Figure 6B:
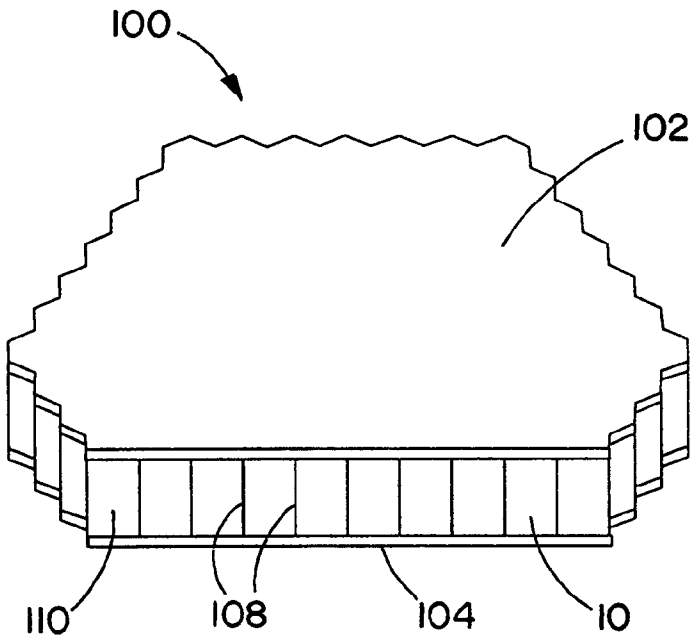
FIG. 6B is an oblique view of the pad of FIG. 6A.
Figure 6A:
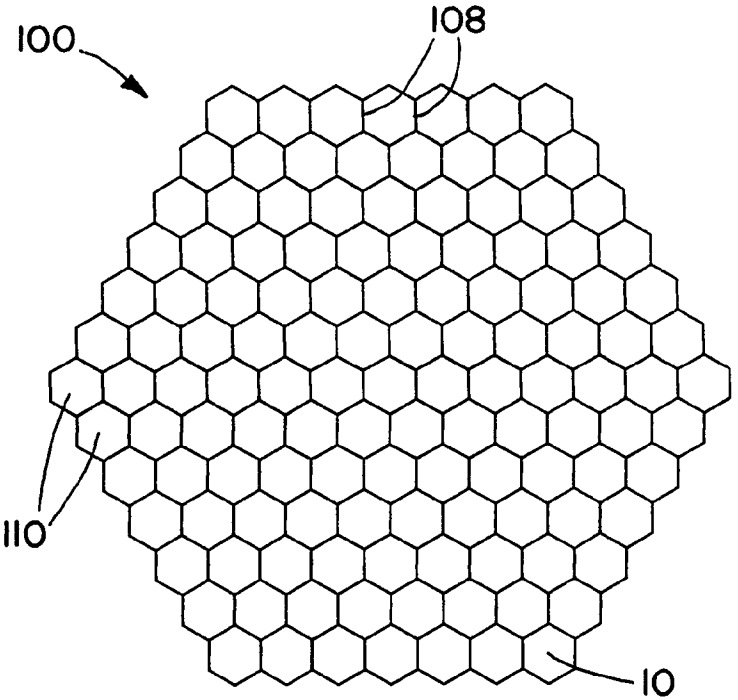
FIG. 6A is a plan view of a shock-absorbing pad according to an embodiment of the present invention.

FIGS. 6A and 6B show a pad 100 that may be used as one of the pads 4 (FIG. 1) for the helmet 1 (FIG. 1). The pad 100 includes a pair of opposed faces 102 and 104 that constitute major surfaces of the pad 100. Between the top face 102 and the bottom face 104 are walls 108 that break the volume of the pad 100 into a series of cells or voids 110 that are filled with the shock-absorbing liquid-particle mixture or material 10 (FIG. 3). The mixture 10 is encapsulated within the pad 100, sealed in the individual cells 110, which are not in fluid communication with one another. The walls 108 between the cells 110 extend from the bottom face 104 to the top face 102, sealing the mixture 10 in the individual cells 110. The faces 102 and 104 need not necessarily be flat surfaces, need not necessarily be parallel to one another, and may in some embodiments be formed as a single piece of material, for example a folded-over sheet material.

In the illustrated embodiment the cells have a hexagonal shape, but other shapes may be used as an alternative. The walls 108 may have substantially constant thickness, as in the illustrated embodiment, although alternatively the walls 108 may have a nonuniform thickness. For example, the walls 108 may be thicker at their bottoms, in order to facilitate molding. The walls 108 may also have a nonuniform thickness or other feature to facilitate bending of the walls 108 in response to an impact or other force. For example, the walls 108 may be kinked, curved, or have thinned sections, to facilitate bending. A hexagonal shape (or other tessellated polygonal shape) has the advantage of providing a maximum of volume for the heterogeneous liquid-particle mixture 10, and a minimal volume for the other parts of the pad 100, the faces 102 and 104 and the walls 108. This maximizes the shock absorbing characteristics of the pad 100, since the mixture 10 has better shock-absorbing characteristics than the rubber or other material used for the walls 108 and the faces 102 and 104. The walls 108 may have a thickness of about 0.5 mm, although a wide range of other thicknesses are possible. The voids or cells 110 (and the mixture 10 that fills them) may have a volume that is at least 50% of the volume of the pad 100, or may have a volume that is at least 60% of the volume of the pad 100, or may have a volume that is at least 80% of the volume of the pad 100.

The faces 102 and 104 may be made of rubber, an elastomer, or another suitable material, for example any of a wide variety of polymer materials or other suitable flexible materials. A flexible material such as rubber or an elastomer is advantageous because it allows the pad 100 to be flexed to conform to a variety of shapes, such as the curved shapes on the inside of the helmet 1. In addition, it is desirable that the walls 108 flex easily, so that the mixture 10 in the cells 110 is performs its intended purpose of internally absorbing (in the particle pores) most of a shock applied to one of the faces of the pad, rather than directly transmitting the shock to the other of face of the pad. Multiple of the pads 100 may be used as the pads 4 of the helmet 1, to absorb shocks from a variety of directions.

The pad 100 may be fabricated by first making the faces 102 and 104, with the walls 108 being integrally formed as part of a single piece with one of the faces, such as with the bottom face 104. Then the mixture 10 is placed in the cells 110. Finally the top face 102 is affixed to the walls 110, through use of an adhesive or another suitable process. A vacuum may be pulled as part of the attachment of the top face 102 to minimize the amount of air in the cells 110 of the assembled pad 100. Once the pad 100 is fabricated it may be adhesively attached to an inside surface of the helmet shell 2 (FIG. 1), for example.

Many alternative configurations are possible for a pad containing the heterogeneous-structure shock-absorbing material 10. For example alternatively the pad may have a pillow shape, or egg shape, or spherical shape, with a flexible casing filled with the shock-absorbing material 10.

Figure 7A:
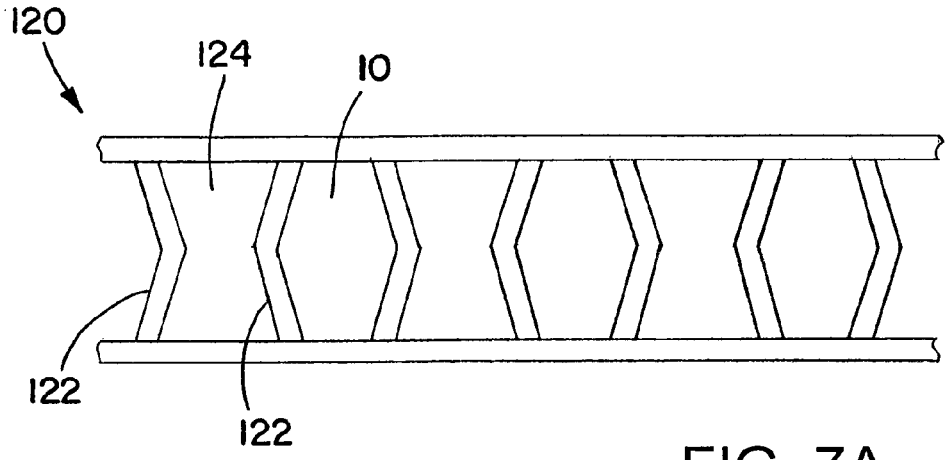
FIG. 7A is a cross-sectional view of a first alternate embodiment pad.
Figure 7B:
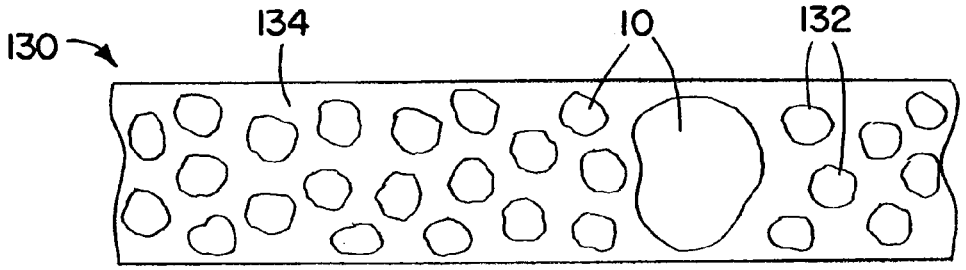
FIG. 7B is a cross-sectional view of a second alternate embodiment pad.
Figure 7C:
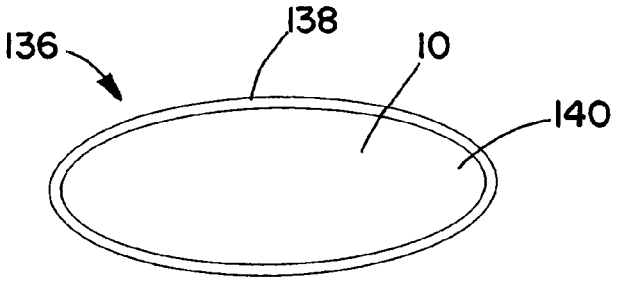
FIG. 7C is a cross-sectional view of a third alternate embodiment pad.

FIGS. 7A-7C show cross-sections of examples of alternative pad configurations. FIG. 7A shows a pad 120 with kinked walls 122 separating cells 124 that contain shock-absorbing material 10. The cells 124 can have any of a variety of shapes, such as polygonal tessellated shapes.

FIG. 7B shows a pad 130 with cavities 132 filled with shock-absorbing material 10. Walls 134 between the cavities 132 prevent flow of the material 10 from one cavity to another. Some of the cavities 132 may be stacked at least in part one on top of another between major surfaces of the pad 130, and/or may be arranged in any of a variety of relative position or orientations. The cavities 132 may have any of a variety of suitable shapes, such as spheroids, ovoids, or irregular shapes.

FIG. 7C shows a pad 136 that has a single outer casing 138 bounding a single cell 140 that is filled with the shock-absorbing material 10. As noted above, the pad 136 may have any of a variety of shapes. The pad 136 may be embedded in another layer of material, such by being part of a pad such as the pad 130 (FIG. 7B).

Figure 8:
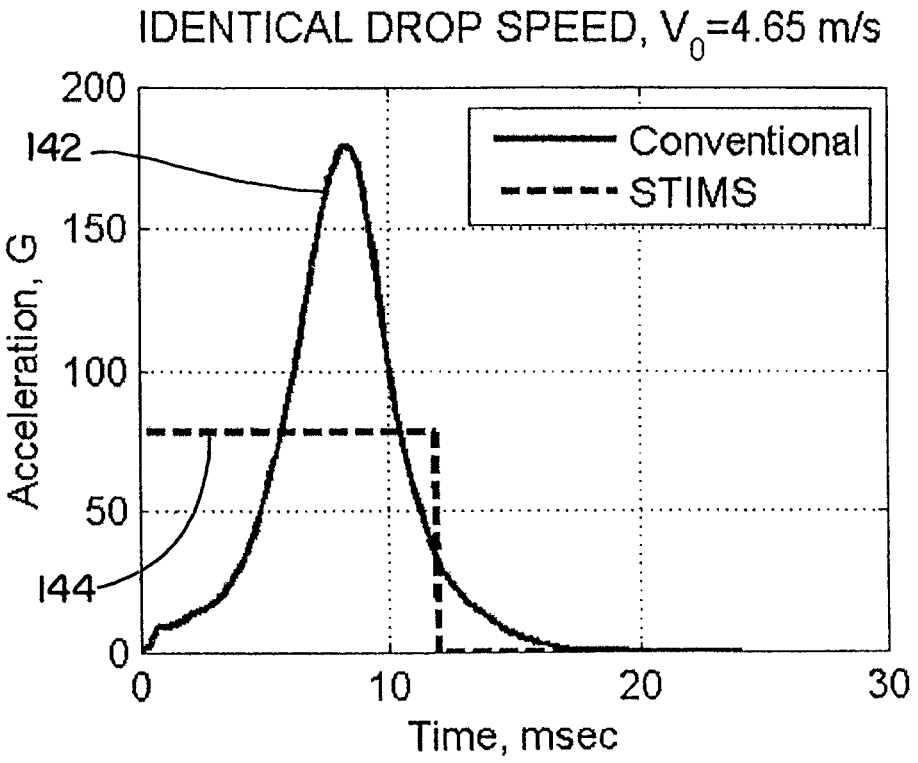
FIG. 8 is a plot of acceleration versus time, showing a representative performance according to an embodiment of the present invention.

Use of a helmet 1 with one or more of the pads 100 can reduce and spread out the accelerations associated with impacts. FIG. 8 qualitatively illustrates the difference in performance that use of the pads 100 can provide. In FIG. 8 the acceleration provided in a system that uses conventional padding (linearly compressive foam material) is shown at 142, taken from ASTM 1292. This information is taken from testing of impact on playground surface material, but can be taken as roughly analogous to impact in other situations, such as in helmets. The acceleration profile for a pad, such as the pad 100, that applied a surface tension impact management system (STIMS; e.g., the shock-absorbing material 10), is shown at 144. The pad 100 spreads out the acceleration over time, and greatly reduces the acceleration peak.

The conventional pad applies a typical force that typically increases monotonically with spring deformation. In the present example, the resulting head acceleration (reference number 142 in FIG. 8) starts at zero, rises slowly, then more rapidly, reaches a ~180 G peak value, and then goes back to zero along an almost symmetrical path to the rising portion of the curve. The symmetrical shape shows that the material dissipates very little energy, that it behaves essentially as an undamped spring. If this type of material was used in a military helmet (with appropriate alterations made for the different uses, such as by selecting an appropriate thickness of the conventional material) with (for example) a 4.65 m/sec drop speed requirement, it would exceed the current military limit of 150 G.

By contrast, STIMS reacts with a pressure nearly independent of strain and strain rates over its design range; once contact is established, STIMS is compressed at a nearly constant pressure until the head comes to rest, and then decompresses at a nearly constant pressure until contact is broken. The resulting head acceleration (reference number 144 in FIG. 8) is approximately a square pulse at a much lower ~80 G level than the peak acceleration of the conventional curve, and well below the maximum permitted acceleration of 150 G. This result is of course a function of many variables including pore sizes, and the particle and liquid material used.

The ~180 G to ~80 G drop represents a 55% reduction in peak acceleration, a very favorable result for military applications. The relative performance of a conventional and a STIMS pad is expected to be similar for higher or lower drop speeds, assuming equal Impulses for both acceleration profiles.

Two traumatic brain injury (TBI) risk criteria that have been employed are the Severity Index (SI), and the Head Injury Index (HIC), both featuring a variant of the 2.5-power dependence on acceleration, as explained below.

The SI criterion is commonly used to rate performance of professional sports helmets. For a pulse extending over the interval 0<t<T, SI is defined as:

$$SI=\int_{t=0}^{T} a^{2.5}\,dt$$

The HIC is commonly used to assess performance of automobile safety devices. It is also used in the aviation industry and sports surfacing world, and is given by:

$$HIC = {}_0^T\max\left((t_1 - t_0)\left[\frac{1}{(t_1 - t_0)}\int_{t=t_0}^{t_1} a_t\,dt\right]^{2.5}\right)$$

For a pulse within the range 0<t<T, HIC calculates the bracketed quantity for all possible $t_0$ and $t_1$, such that $0<t_0<t_1<T$, and reports the maximum value.

Application of the above two criteria to the conventional and STIMS acceleration profiles of FIG. 8 yields the following results shown in Table 1:

TABLE 1

Performance Comparison

| Pad Type | SI | HIC |
|---|---|---|
| Conventional | 1233 | 1018 |
| STIMS | 640 | 628 |

For the example shown in FIG. 8 STIMS reduces SI and HIC by 50% and 40%, respectively, showing that STIMS padding is effective in non-military applications, too. This results from the 2.5-power dependence of SI and HIC that a) weigh heavily the pronounced peak of the conventional pads; and, b) weigh mildly the lower constant acceleration profile of STIMS.

The pads 100 may have any of a variety of suitable sizes. For example, for use in a helmet, the pad 100 may have a diameter on the order of a few centimeters. The pads 100 may also be used in a wide variety of other situations where shock absorption is desirable, such as in other types of padding for athletic or other uses, car vehicle bumpers, and shock absorbers, to give a few examples.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A helmet comprising:
a shell; and
a pad within the shell;
wherein the pad includes a shock-absorbing material;
wherein the shock-absorbing material includes:
a carrier liquid; and
solid particles within the liquid; and
wherein the solid particles have pores with pore surfaces that are lyophobic with respect to the carrier liquid.

2. The helmet of claim 1, wherein each of the particles has homogeneous material content throughout.

3. The helmet of claim 1, wherein the solid particles each include a lyophobic material coating along the pores.

4. The helmet of claim 3, wherein the lyophobic material coating is on substantially all of exposed surfaces of the solid particles.

5. The helmet of claim 3, wherein exposed surface of the particles outside of the pores are lyophilic with respect to the carrier liquid.

6. The helmet of claim 1, wherein the shell is a hard plastic shell, with the pad attached to an inner surface of the shell.

7. The helmet of claim 1, wherein the helmet is one of an athletic helmet, a military helmet, or a civilian-use helmet.

8. The helmet of claim 1, wherein the pad includes multiple cells in which shock-absorbing material is enclosed, with walls between the cells preventing fluid communication between the cells.

9. The helmet of claim 8, wherein the pad includes a pair of faces defining opposed major surfaces of the pad, with the cells extending between the faces.

10. The helmet of claim 9, wherein the shock-absorbing material constitutes at least 40% of the combined volume of the faces, the walls, and the shock-absorbing material.

11. The helmet of claim 9, wherein the walls between the cells are integrally formed with one of the faces as a single piece of material.

12. The helmet of claim 9, wherein the faces and the walls are all made of the same material, and/or wherein the faces and the walls are all made of flexible material.

13. The helmet of claim 1, wherein the carrier liquid has a freezing temperature that is −30 degrees C. or lower.

14. The helmet of claim 1, wherein the carrier liquid has a lower freezing temperature than water.

15. The helmet of claim 1, wherein the solid particles are made from controlled porosity glass.

16. The helmet of claim 1, wherein the solid particles have at least 50% of their volume taken up by the pores.

17. The helmet of claim 1, wherein the pores have a Laplace pressure of from 10 psi to 100 psi.

18. A shock-absorbing pad comprising:
a flexible multicell structure having a plurality of sealed cells; and
a shock-absorbing material in the sealed cells;
wherein the shock-absorbing material includes:
a liquid; and
solid particles within the liquid;
wherein the solid particles have lyophobic pores; and
wherein the sealed cells constitutes at least 60% of the volume of the pad.

19. The shock-absorbing pad of claim 18, wherein the structure includes walls between the cells preventing fluid communication between the sealed cells.

20. The shock-absorbing pad of claim 19, wherein the structure includes a pair of faces defining opposed major surfaces of the pad, with the sealed cells extending between the faces.

21. The shock-absorbing pad of claim 20, wherein the shock-absorbing material constitutes at least 80% of the combined volume of the faces, the walls, and the shock-absorbing material.

22. The shock-absorbing pad of claim 20, wherein the walls between the sealed cells are integrally formed with one of the faces as a single piece of material.

23. The shock-absorbing pad of claim 20, wherein the faces and the walls are all made of the same material, and/or wherein the faces and the walls are all made of flexible material.

24. The shock-absorbing pad of claim 18, wherein the sealed cells are in a tessellated configuration.

25. The shock-absorbing pad of claim 18, wherein the sealed cells are in a hexagonal configuration.

26. The shock-absorbing pad of claim 18, wherein the solid particles are made from controlled porosity glass.

27. The shock-absorbing pad of claim 18, wherein the solid particles have at least 50% of their volume taken up by the pores.

28. The shock-absorbing pad of claim 18, wherein the pores have a Laplace pressure of from 10 psi to 100 psi.

29. The shock-absorbing pad of claim 18, wherein the pores have a Laplace pressure of from 10 psi to 50 psi.

30. The shock-absorbing pad of claim 18, wherein the pores have a Laplace pressure of from 20 psi to 40 psi.

31. The helmet of claim 1, wherein the pores have a Laplace pressure of from 10 psi to 50 psi.

32. The helmet of claim 1, wherein the pores have a Laplace pressure of from 20 psi to 40 psi.

* * * * *